US005598649A

United States Patent [19]

Geiger

[11] Patent Number: 5,598,649

[45] Date of Patent: Feb. 4, 1997

[54] FRICTIONAL FORCE COMPENSATION FOR LAUNDRY MANGLES

[75] Inventor: Friedrich Geiger, Todtenweis, Germany

[73] Assignee: Böwe-Passat Reinigungs und Wäschereitechnik GmbH, Augsburg, Germany

[21] Appl. No.: 574,362

[22] Filed: Dec. 18, 1995

Related U.S. Application Data

[63] Continuation of Ser. No. 211,053, Jul. 25, 1994, Pat. No. 5,499,464.

[30] Foreign Application Priority Data

Sep. 27, 1991 [DE] Germany ..... 41 32 213.4

[51] Int. Cl.[6] ..... D06F 63/00

[52] U.S. Cl. ..... 38/46

[58] Field of Search ..... 38/44–48, 52, 38/58–61, 10, 16, 18; 100/93 B, 53 RP, 163 A, 164, 166, 169

[56] References Cited

U.S. PATENT DOCUMENTS

| | | | |
|---|---|---|---|
| 2,657,483 | 11/1953 | Zwaard | 38/58 |
| 5,499,464 | 3/1996 | Geiger | 38/46 |

FOREIGN PATENT DOCUMENTS

| | | | |
|---|---|---|---|
| 622646 | 12/1935 | Germany . | |
| 24331 | 4/1959 | Germany . | |
| 1211122 | 2/1966 | Germany . | |
| 1813594 | 6/1970 | Germany . | |
| 6605766 | 8/1970 | Germany . | |
| 3401802 | 7/1985 | Germany . | |
| 3507168 | 9/1986 | Germany | 38/44 |
| 3618423 | 8/1987 | Germany . | |
| 3627632 | 2/1988 | Germany . | |
| 279277 | 5/1990 | Germany | 38/60 |
| 9004179 | 7/1990 | Germany . | |
| 0351381 | 10/1972 | U.S.S.R. . | |
| 2088416 | 6/1982 | United Kingdom . | |
| 8503313 | 8/1985 | WIPO | 38/44 |

*Primary Examiner*—Ismael Izaguirre
*Attorney, Agent, or Firm*—Wigman, Cohen, Leitner & Myers, P.C.

[57] ABSTRACT

A laundry mangle has at least one mangling roller held in a working position inside a heatable trough by at least one carrying arm. The mangle roller and the trough are held in relative moveable positions by at least one adjusting member, delimiting together the inlet and outlet sides of a passage for laundry pieces. The adjusting member allows a force to be exerted on the mangling roller and/or trough that counteracts the frictional force generated during operation of the mangle, so that a constant or increasing ironing pressure towards the outlet side is set. The frictional force (R) generated during mangling is thus compensated, so that a gentle, wear-free mangling process is achieved. In addition, the mangling capacity is increased, compared with known mangles.

9 Claims, 4 Drawing Sheets

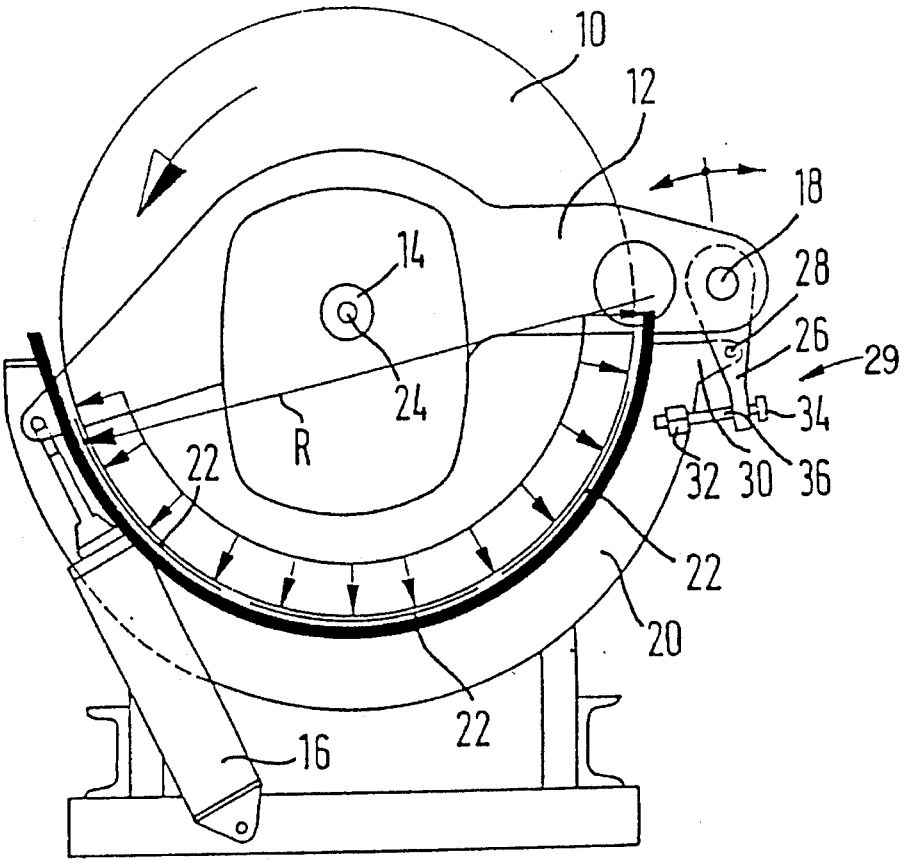
FIG. 1
FIG. 2
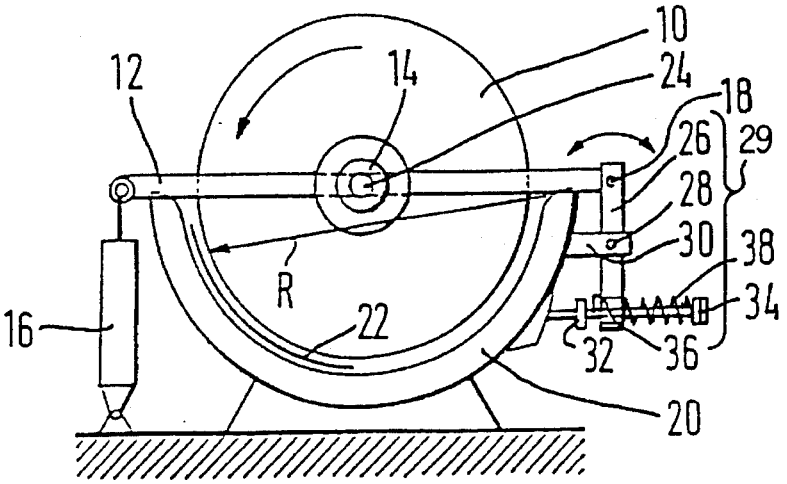
FIG. 3
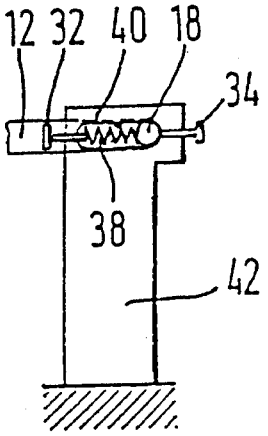

FRICTIONAL FORCE COMPENSATION FOR LAUNDRY MANGLES

This is a continuation application Ser. No. 08/211,053 filed on Jul 25, 1994, now U.S. Pat. No. 5,499,464.

BACKGROUND OF THE INVENTION

The invention relates to a laundry mangle comprising at least one mangle roller, which is held in a service position by means of at least one supporting arm in a heatable trough. The mangle roller and the trough assume a moveable position relative to each other having at least one adjusting means that defines an inlet and outlet for the passage of laundry articles.

A conventional laundry mangle described in PCT/WO 85/03313 includes several mangle rollers arranged successively in series. Due to the adjustability of the respective mangle roller to the assigned trough, an approximately parallel, preferably coaxial positioning of the longitudinal axes of the roller and semi-rotary cylinder can be obtained, a feature that should guarantee a frictionless operation of the mangle. Furthermore, it is possible to swing the mangle roller completely into or out of the trough, in order to have unimpeded access to the trough, for example, for the purpose of removing the laundry articles that have become either caught, or for cleaning and/or for ventilation.

To this end, the ends of the bearing axle of the respective mangle roller can be rotated using a pair of supporting arms, which can be swung up and down by means a working cylinder around a stationary bearing point. To provide a frictionless operation, the bearing, which can adjusted within a narrow range, in the form of a bearing point, is then set in such a manner that a coaxial service position between mangle roller and assigned trough is achieved as far as possible; a position that is then fixed in the effective service position.

The friction generated in this service position that is set once, between the mangle roller and the surface of the trough and that should have as low a value as possible does not remain, however, uniform and constant during service. First, due to its torque the driven mangle roller has the tendency to move in the direction of the trough on the inlet side of the mangle, a state that reduces on the inlet side the distance between mangle roller and trough, thus resulting in raised frictional values at this point. Secondly, the friction on the trough surface changes in an irregular and unpredictable manner, due to for example, nonuniform heating, or, during the introduction of laundry articles having different sizes, thicknesses and also frictional values. As these articles are dragged along by the roller surface friction results along the trough surface This frictional force thus generated leads to a nonuniform and raised ironing pressure especially in the inlet sided region of the mangle. At the same time the mangle performance drops, since the ironing pressure on the laundry outlet side of the mangle drops due to the corresponding increase in distance from the trough, thereby reducing the thermal transfer required. In the inlet sided region, the ironing pressure increases only insignificantly as the pressure increases. The high pressure on the inlet side results in an undesired high wear not only on the laundry articles but also on the roller lining applied on the surface of the mangle roller.

A mangle of the aforementioned type is described in DD-PS 24 331, where the mangle roller and the trough assume by means of the adjusting means a moveable position relative to each other while the mangle is operating. On both sides the mangle roller is mounted on a supporting arm, by means of which it can be swung out; and simultaneously a drive wheel for the mangle roller is mounted on the swivel pin. Mangle roller and drive wheel are connected by the meshing of a gear wheel. To eliminate the resulting tooth pressure, which leads to a nonuniform ironing or pressing pressure within the trough, the known rotary mangle provides that between the gearwheel of the roller axle that exhibits the same or approximately the same diameter, and the actual drive wheel on the supporting arm there is an intermediate wheel, which can also be swung out. Furthermore, a spring energy store engaging at the support arm is provided as the adjusting means. The addressed deleterious tooth pressure is, in fact, eliminated with this known mangle. Yet at the same time forces are generated that push the mangle roller on the inlet side against the trough and move away from said trough on the outlet side. The result is an increase in the frictional force and thus a nonuniform ironing pressure that is excessive on the inlet side with the aforementioned drawbacks.

Another mangle of this type is described in DE-OS 1 813 594 wherein the mangle roller is suspended rotatably from a supporting arm, which forms a rocking arm and which is attached in such a manner to a mangle housing that it slopes upward from the roller axle to the housing suspension, thus resulting in an angle ranging from 0° to 90° between the rocking arm and a horizontal line extended through the center point of the roller, when seen in the direction of rotation. The larger the angle is chosen, the greater is also the contact force of the roller on the trough, and the greater is the frictional force between the mangle roller and the trough. Not to exceed at this stage a deleterious maximum frictional value as the strength of the laundry articles increases, the trough can be swivelled flexibly by means of adjusting means as a spring energy store. With this known laundry mangle the resulting frictional force can be compensated for only partially and in particular the ironing pressure cannot be set either constantly or increasingly in the direction of the outlet side.

In another type of conventional laundry mangle which is described in DE-AS 1 211 122 the mangle roller is pivot-mounted on supporting arms by means of one pair and enveloped in the swung-in state stationarily by an ironing trough, which is designed as a half shell and whose free ends are driven by means of a mechanical device or with a heating medium in such a manner that they move toward each other during service in order to increase the ironing pressure, thus reducing on the inlet and outlet side the distance between the mangle roller and trough. In addition to decrease the pressing pressure the mangle roller can be simultaneously lifted by means of the two supporting arms. With this known mangle roller the ironing pressure for the laundry articles can be increased on the inlet and outlet side, so that at these points altogether high frictional values with the drawbacks described above are generated. contrast, the frictional values drop in the center of the trough and the ironing pressure decreases dramatically, so that altogether the mangle output of this known mangle is low.

Thus, it can be seen from the prior art, that there is a need to provide a laundry mangle, where the described drawbacks are avoided.

SUMMARY OF THE INVENTION

The laundry mangle according to the invention, generates a force which counteracts the frictional force generated during service of the laundry mangle such that the ironing pressure is constant or increases in the direction of the outlet side. The force is exerted by the respective adjusting means on the mangle roller and/or the trough, which assumes during service a moveable position relative to each other. A dynamic adaptation of the position of the mangle roller and the trough to each other during service of the laundry mangle is achieved. Thus, during service the force compensating for the frictional force increases or decreases, depending on whether the frictional force acting between the mangle roller and the trough increases or decreases. In so doing, first the distance between the mangle roller and the trough increases in principle on the inlet side and then decreases on the outlet side during service of the mangle.

By such action, an undesired increase in the ironing pressure in the feed sided region of the mangle is reliably avoided. Instead the compressive load per unit area remains constant or increases in the direction of the outlet side along the entire ironing gap, formed between mangle roller and trough. This allows a careful pressing of the laundry with reduced wear, especially at the roller lining. Size and direction of the frictional force and thus the compensating force result from the contact pressure and direction of rotation of the roller, within the scope of the present invention is basically irrelevant whether the roller is braced moveably with respect to the roller, attached stationarily with its bearing axle, against the compensating force of the force-generating device.

Provided the respective adjusting means act in such a manner that the ironing or pressing pressure increases constantly in the direction of the outlet side, increased mangling output can be obtained. Owing to the relatively high temperature difference between the laundry articles, introduced on the feed side, and the heating temperature in the ironing gap there, no improved drying results can be obtained any more even with relatively high ironing pressures. However, this state improves if the temperature differential decreases following passage through the respective trough. If then a correspondingly high ironing pressure is generated on the outlet side, the result on average is significantly improved thermal transmission coefficients. If viewed from the point of view of total energy, in the laundry mangle designed to this end, the mangle output compared to a laundry mangle with constant ironing pressue is definitely raised over the entire trough surface, without resulting, however, in a wear of the laundry articles and/or the mangle. For the following troughs the mangle output can be optimized to the effect that for a roller, which follows immediately in the conveying direction and exhibiting a trough, a uniform ironing pressure is set by means of the adjusting means; and for the roller that follows last and exhibits a trough the ironing pressure is set so as to decrease in the direction of the output side. The mangle roller arranged last when seen in the conveying direction discharges the already dried laundry articles, without any unnecessary overheating, damaging the laundry articles, on the outlet side. These embodiments make it clear that with suitable adjustment of the setting means for the laundry mangle according to the invention, the conventional design of a laundry mangle can also be realized, provided it seems expedient with regard to energy considerations. Thus, with the laundry mangle according to the invention, a wide band range of possible operating modes for a mangling process of laundry articles can be realized, without necessitating any significant structural modifications.

In an especially preferred embodiment of the laundry mangle according to the invention, two working cylinders are provided, of which one absorbs the gear-sided driving torque. On the basis of this arrangement a uniform ironing pressure within the trough can be generated with two identical working cylinders when the lever arm is shortened on the so-called exhaust air side of the laundry mangle, a feature that can lower the production costs of the laundry mangle according to the invention.

Other features and advantages of the present invention will become apparent from the drawings and the description which follows.

BRIEF DESCRIPTION OF THE DRAWINGS

FIG. 1 is a side elevational view of the drive side of a laundry mangle made in accordance with the present invention showing obliquely engaging working cylinder and moveable roller bearing to compensate for the frictional force.

FIG. 2 is a side elevational view of a laundry mangle made in accordance with the invention with flexibly braced roller bearing.

FIG. 3 is a modified embodiment of the roller bearing of FIG. 2.

DETAILED DESCRIPTION OF THE EMBODIMENTS

Figure 4:
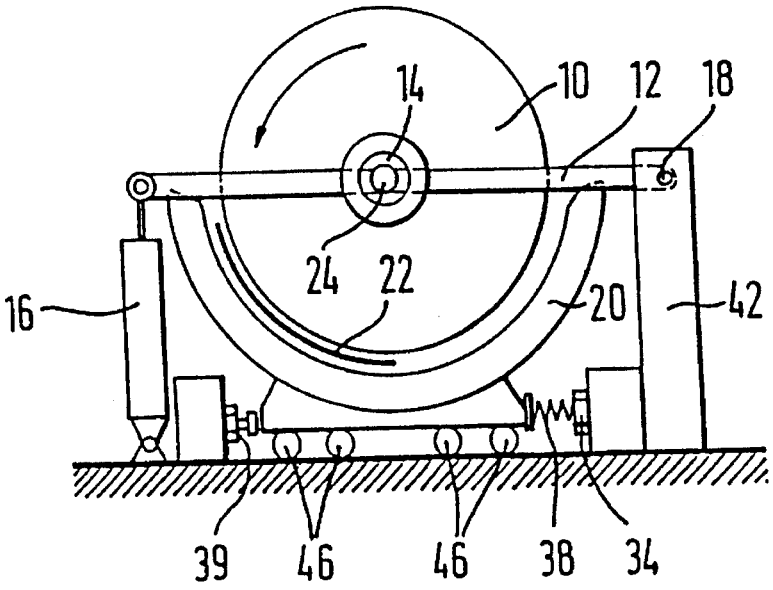
FIG. 4 is a side elevational view of a laundry mangle with trough, which is flexibly braced and can be set relative to the stationary mangle roller.

Referring now to the drawings wherein like numerals indicate like elements throughout the several views, there is seen in FIG. 1 a mangle comprising mangle roller 10 which is pivot-mounted in a pair of bearings 14 at a pair of lever arms 12. Mangle roller 10 is driven by means of a drive (not shown) counterclockwise according to the direction of the arrow, as seen in FIG. 1. Roller 10 can be swung around a swivel pin 18 by working cylinder 16 both up and down, out of or into the stationary, heatable ironing trough 20.

Lever arms 12, of which only the front arm is visible in the drawing, is operatively connected to cylinder 16 at one end and to swivel pin 18 at the other end, and to roller 10 therebetween. The swivel pin 18 is formed, for example, by means of a torsion shaft, which connects together the two arms of the pair of lever arms 12 as a part of the lever linking. The laundry articles 22 travel through the mangle from the input side to the output side, thus from left to right in the direction of the arrow as seen in FIG. 1.

The bearing axle 24, whose ends are held in the two bearings 14, has a substantially horizontal orientation and extends transversely to the longitudinal directions of both arms of the pair of lever arms 12. The bearing axle 24 coincides with the longitudinal axis of the heatable trough 20, thus assigned to said trough coaxially. The imaginary longitudinal axis of the trough 20 is obtained in this case, if the ends of trough 20 that are free at the top are connected together by means of an imaginary plane and a line is drawn in approximately the center of said plane between the two free ends.

The swivel pin 18 whose ends form a bearing point for the respective lever arm 12 is mounted with its two end sided pins in a pair of levers 26, which forms another part of the lower linkage and whose levers can be swivelled around a pivot pin 28 and are connected to the ironing trough 20 by means of one part of the linkage 30. The position of this pair of levers 26 are attached by means of two control elements 32 and 34 that define the range of swivel as seen in FIG. 1. Threaded rod 36, hinged to the trough 20, is guided through an eye at the free end of one arm of the pair of levers 26. Final control elements 32, 34, which may be a screwhead or a setscrew, are located on rod 36. Preferably, a setter for both levers of the pair of levers 26 is provided. Thus, the pair of levers 26 can be moved freely with play along the threaded rod 36 and restricted in movement, in particular by means of the final control element 34. The possible swivel range of the pair of levers 26 is shown by the double arrows in FIG. 1.

If the sum of all frictional forces generated in the system—rollers 10, trough 20 and optionally the laundry articles 22—is formed, the result is a summation vector, whose size and direction is reproduced approximately in FIG. 1 by means of a force vector, denoted as "R". This frictional force (R) results in an increase in the compressive load per unit area on the inlet side of the laundry mangle and a restriction in the gap between the roller 10 and trough 20 at this spot. Furthermore, the gap between the roller 10 and the trough 20 enlarges on the outlet side of the laundry mangle. If the force vector (R) is dissected into its components, the result is not only a vertical force component acting downwardly as seen in FIG. 1 but also a horizontal vector, whose direction acts in the direction of the inlet side, to the left when viewed in FIG. 1.

The force-generating device, which is shown here as working cylinder 16 can be a fluid or pneumatic cylinder. The force generating device is selected to stipulate the force to be generated by it, by hydraulic or pneumatic controls.

To generate a counteracting counter or retaining force, the working cylinder 16 engaging first with the pair of lever arms 12 is sloped in a manner such that, in addition to a vertically oriented force component, it can also exert a horizontal force component on the bearing axle 24, which counteracts the horizontal force component of the frictional force (R) and whose size corresponds in essence to it. Thus, mangle roller 10 is pushed away from the trough surface on the inlet side counter to the direction of the frictional force (R), in order to reduce the normal tension acting there. In addition, the already addressed final control elements 32 and 34, which limit the maximum possible swiveling range of the pair of lever arms 12 when the counter force is generated, serve as a steadying or retaining surface in the event the mangle roller 10 is lifted out of the ironing trough by means of the working cylinder 16.

The size of the frictional force (R) can be calculated or measured. Moreover, its size and direction is largely known for mangle service with the aid of empirical values. With the aid of the values obtained thus for the frictional force (R), the setting angle of the working cylinder 17 amd thus the force to be generated by it can be derived. To obain the constant ironing or pressing pressure, which is shown in FIG. 1 and which is indicated with a semi-circular vector picture, or to obtain an ironing or pressing pressure (not illustrated) that increases constantly in the direction of the outlet side, a fixed, enlarged distance or decreased distance can be set on the inlet side or on the outlet side between the ironing trough 20 and the mangle roller 10. Since, however, the mangle roller 10 is not fixed in position with its swivel pin 18, but rather can pivot by means of the pair of levers 26 with a specifiable play in the direction of the double arrows, a dynamic force equilibrium is given during service of the laundry mangle, whereby the mangle roller 10 moves automationally in such a manner relative to the trough 20 as a function of the generated frictional values that the frictional values are compensated for. In another embodiment of the invention, working cylinder 16 acts as a damping element, which elastically cushions the stresses that occur and also contributes to the minimization of the frictional values.

The following embodiments are only explained insofar as they differ from the embodiment described above. The same reference numerals are used for the components exhibiting the same functions as in the first embodiment.

In the embodiment according to FIG. 2, the working cylinder 16 is hinged with its direction of force extending vertically to the pair of lever arms 12. Moreover, the adjusting means or the force-generating device is provided as a compensation spring 38, which can be moved on the rod 36. Spring 38 acts to push the bottom end of the assigned lever of the pair of levers 26, seen to the left in FIG. 1, thus the roller 10, which rotates counterclockwise in the trough 20 during service and rubs therein, to the right against the acting frictional force (R). The amount of spring pressure is determined at start-up by actuating the final control element 34 in accordance with the average frictional forces, which is to be expected and which can be calculated, measured or also obtained from empirical experience. The possible swiveling range of the pair of levers 26 is shown in turn by means of the double arrows in FIG. 2. Furthermore, the final control element 32 serves to reliably define the range of motion of the pair of levers 26 and could also be omitted. Due to the floating bearing of the swivel pin 18, a dynamic adaptation to changing frictional values is given by the adjusting means, which in this embodiment is compression spring 38.

In the embodiment shown in FIG. 3, the bearing of the swivel pin 18, thus the respective bearing point, is provided in an oblong hole 40 of a stationary frame 42, instead of at a pair of levers 26, as shown in FIGS. 1 and 2. The swivel pin 18 can be set by means of setting means, which are also formed by the final control elements 32 and 34. Here the compression spring 38 acts to push the bearing of the swivel pin 18 or the respective pin of the torsion shaft, seen in FIG. 2 from left to right, against the stop of the final control element 34. Preferably, the springy bearing is provided on both sides or both ends of the swivel pin 18 of the pair of levers 12.

In the arrangement according to FIG. 4, the trough 20 can be moved on rollers 46 while the bearing axle 24 is mounted in a stationary position. The force of a compression spring 38 can be set by means of a final control element in the form of a setscrew 34. Spring 38 pushes against the trough 20 in the horizontal direction in the same manner as in the case of the setter according to FIGS. 2 and 3. Due to the force of the compression spring 38 the trough 20 is moved to the left, as seen in Fog. 4, so that the ironing pressure rises on the outlet side and falls on the inlet side, until a substantially constant compressive load per unit area prevails along the entire ironing gap. To limit the free distance traversed by the trough 20, a limiting element 39 is provided in the form of a setscrew, which occupies a specified distance to the trough 20, so that there is little play between setscrew 39 and trough 20.

Figure 5:
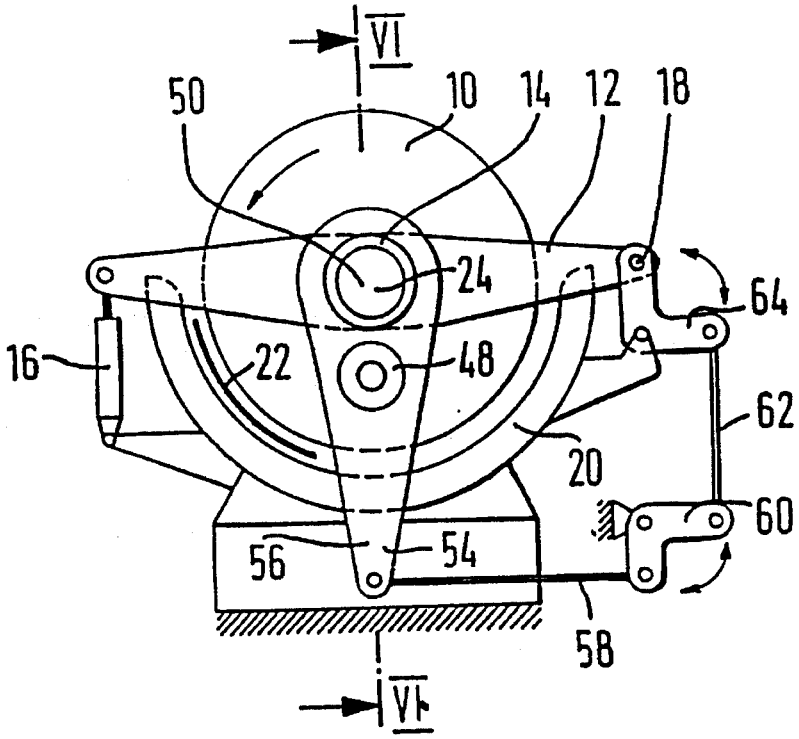
FIG. 5 is a side elevational view of a laundry mangle with compensation for the frictional force caused by the roller drive forces.
Figure 6:
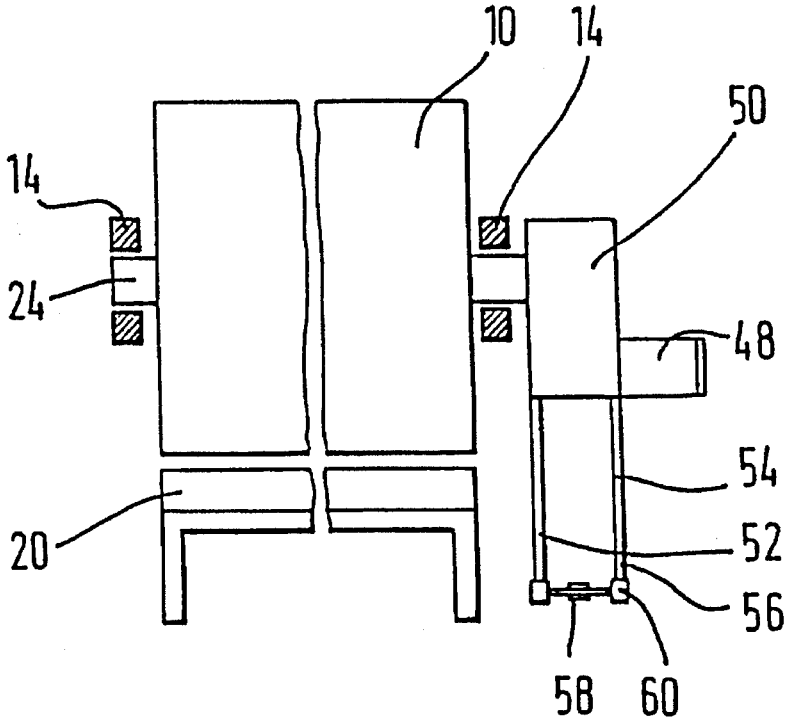
FIG. 6 is a sectional view taken according to line VI—VI of FIG. 5.

FIGS. 5 and 6 show an embodiment, in which the driving torque, which is exerted on the roller 10 and also causes the roller friction, is virtually compensated for. At the same time the driving torque itself serves to compensate for the frictional force produced between roller 10 and trough 20. The mangle roller 10 mounted in turn on a pair of lever arms 12 is driven by means of a drive unit, sitting on the bearing axle or on the shaft 24 of the mangle roller 10 and comprising a motor 48 and a gear 50. From this drive unit 48, 50 extends, seen from the botton in FIG. 5, a second lever arm 56 formed by two legs 52, 54.

Rod 58 is hinged to lever arm 56. Rod 58 transfers a force exerted by the lever arm 56, to a first angle lever 60, which is hinged stationarily and which upwardly diverts the force by approximately 90°, (FIG. 5) to rod 62. Rod 62 actuates a second angle lever 64, which is hinged to the stationary trough 20 and which transfers the force, which is transferred by the rod 62 and diverted by another 90 °, to the lever arm 12. At the same time the angle lever 64 approximates with regard to its function the pair of levers 26 of the embodiments according to FIGS. 1 and 2, except that here the compensating force is formed directly by means of the driving torque of the roller 10, which is transferred to the bearing axle 24 by means of the lever linkages 56, 58, 60, 62, 64, 12.

The result of the idle bearing of the motor 48 and the gear 50 in the second lever arm 56 is, in addition to the driving torque of the mangle roller 10 when rotating in the direction of the arrow according to FIG. 5, a counter-torque on the lever arm 56. Lever arm 56 is swiveled clockwise about the bearing axle 24 and moves to the left out of its position thereby setting into motion the following lever linkage in such a manner that the mangle roller 10 is moved again in the direction of the outlet side of the laundry mangle. The compensation for the frictional force extends over the entire working width of the mangle.

Figure 7:
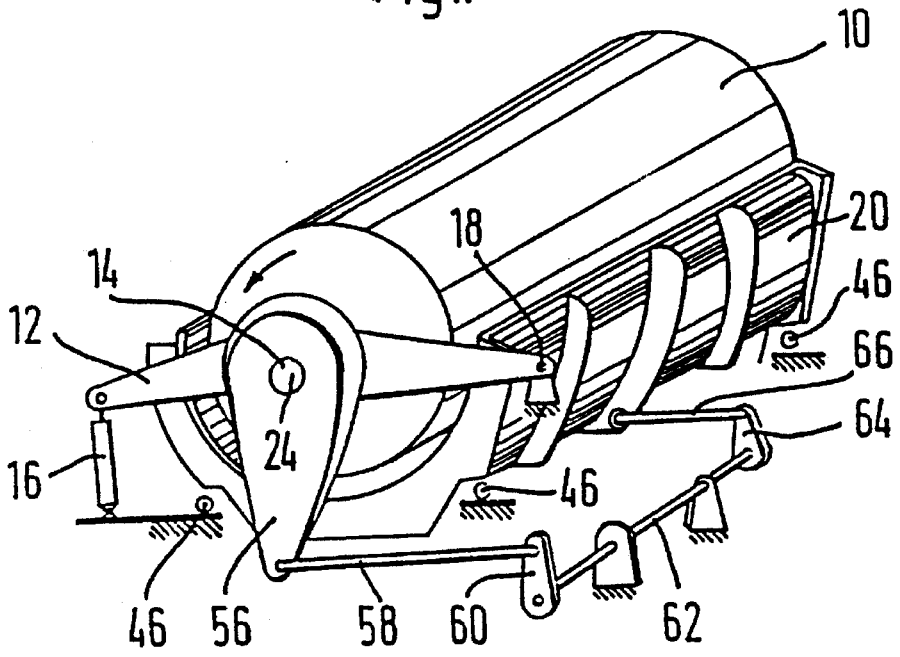
FIG. 7 is a perspective view of the laundry mangle of FIG. 5 showing a stationary mangle roller and an adjustable trough.

FIG. 7 is a perspective view of the apparatus corresponding to FIGS. 5 and 6 wherein mangle roller 10 is held stationarily with its bearing axle 24 and the trough 20 is held moveably by way of a floating bearing in the form of rollers 46. The idle bearing of motor 48 and gear 50 within the second lever arm 56 leads in the case of the drive direction of the mangle roller 10 shown in FIG. 1 to a clockwise torque of the second lever arm 56. At the same time the trough 20 is moved to the left out of its position shown there, over the rollers 46, as seen in FIG. 7, by means of the lever linkages, comprising the members 58, 60 62, 64 and 66, thus resulting in the ironing gap becoming narrower on the outlet side. In this arrangement the result is a dynamic adaptation as a function of the respective frictional forces that occur.

In all of the above described embodiments either the mangle roller 10 or the trough 20 has been moved. Through a suitable combination of roller 10 and the ironing trough 20 can be moved simultaneously are also possible.

Sensor elements as disclosed in PCT/WO 85/03313, can be employed for measuring the compressive load per unit area within the ironing gap between the mangle roller 10 and the ironing trough 20. The values determined thus could then be fed by way of a controller to the final control element (not shown), which then moves the mangle roller 10 and/or the ironing trough 20 relative to each other depending on the situation, in order to produce a uniform compressive load per unit area. Such final control elements can be formed by working cylinders whose end side engages with the bearing axle 24 in order to adjust the roller 10.

The power input caused by the driving torque of the roller can also be measured as the function of the frictional value and thus drive the power-generating device in the form of the respective adjusting means compensating for the friction. It is also contemplated that the compensating force is selected in such a manner that not only the frictional force is compensated for, but also the laundry entry gap on the inlet side is somewhat larger than the exit gap on the outlet side, in order to facilitate the feed on the laundry articles into the mangle.

Figure 8:
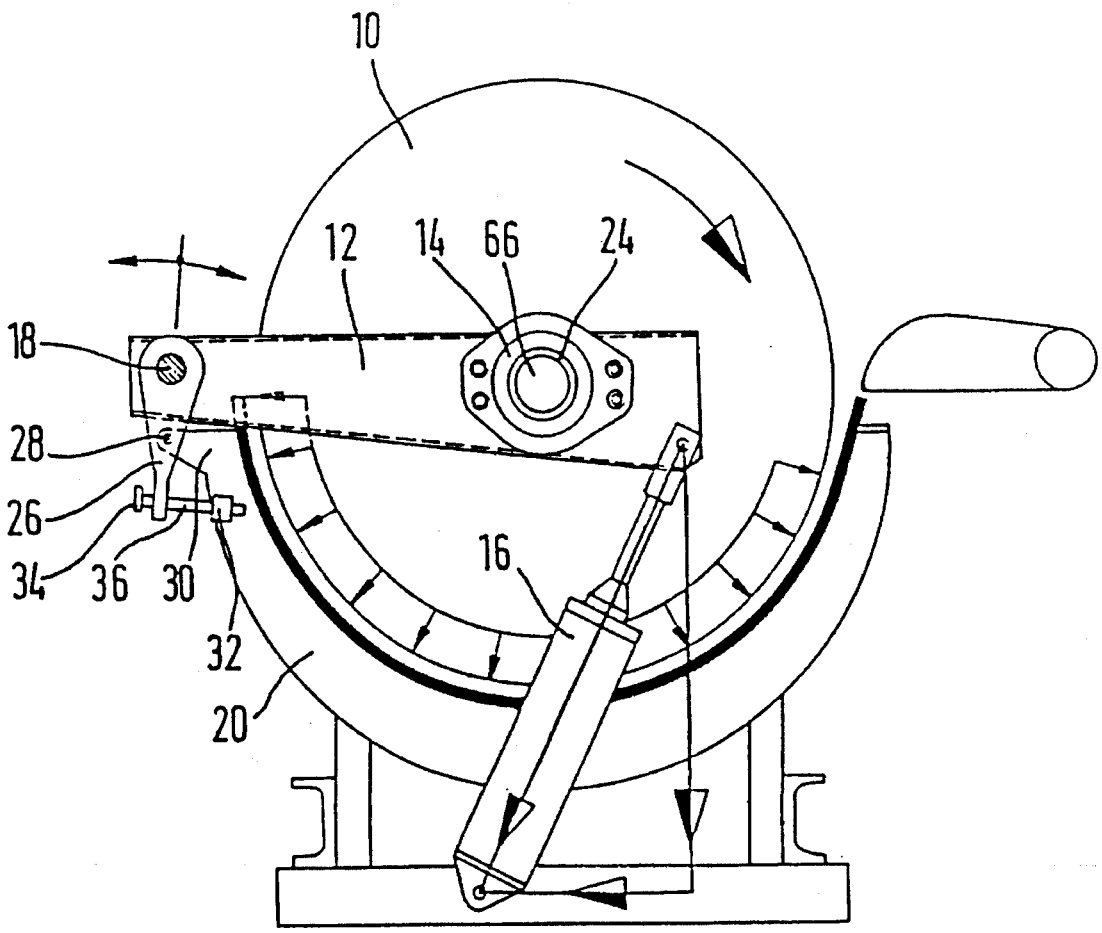
FIG. 8 is a side elevation view of the laundry mangle of FIG. 1 shown from the exhaust side of the laundry mangle.

FIG. 8 shows the exhaust air side of the laundry mangle according to the invention. It also shows the rear side of the mangle roller 10. Exhaust air opening 66 placed in the center of the bearing 14 is connected in a known manner and therefore, not illustrated in detail to a distributor network of a steam exhaust system. The working cylinder 16 disposed there does not have to absorb the gear-sided driving torque on the exhaust side of the laundry mangle. Rather, this driving torque alone can occur, according to FIG. 1, by the working cylinder 16. Working cylinder 16 has, according to FIG. 8, merely to engage a shorter lever arm of the pair of lever arms 12 which results in a uniform ironing pressure. Working cylinder 16 according to FIG. 8 could, as shown in FIG. 1, also engage a longer lever arm. Since it would not have to generate all of the force it could be smaller. To obtain a uniform ironing pressure or to increase the ironing pressure in the direction of the outlet side, working cylinder 16 is provided each arm of the pair of lever arms 12 for support. However, it is contemplated that a single working cylinder can be used to support the roller 10 in its longitudinal direction. For a better overview, the force triangle for the working cylinder 16 shown there is also denoted with vector arrows in FIG. 8. To compensate for the frictional force, the working cylinders 16 can also function with a calculated, specified force, thus resulting in a kind of static arrangement. However, a dynamic compensation would also be conceivable where, for example, the respective cylinder 16 is driven so as to compensate continuously by way of a computer by means of suitable sensors in the ironing gap.

Although only preferred embodiments are specifically illustrated and described herein it will be appreciated that many modifications and variations of the present invention are possible in light of the above teachings and within the purview of the appended claims without departing from the spirit and intended scope of the invention.

I claim:

1. Laundry mangle for counteracting a frictional force generated during service of the laundry mangle, said mangle comprising at least one mangle roller, at least one arm for supporting said mangle roller in a heatable trough in a service position, said mangle roller and said trough being movably positioned relative to each other, inlet and outlet passages for laundry articles provided between said mangle roller and heatable trough; a force generating mechanism which counteracts the frictional force generated during service of the laundry mangle comprising an adjusting device acting on said mangle roller, said force generating mechanism is inclined from a vertical direction and thereby generates forces in both the vertical direction and in a horizontal direction, wherein said adjusting device engages said supporting arm, and said supporting arm is swivelable about a point for a movement selected from the group of movements consisting of translation and rotational movement in the service position, wherein said point is a movable bearing point.

2. Laundry mangle, as claimed in claim 1, wherein said trough is longitudinally movable and wherein said adjusting device acts directly on said trough.

3. Laundry mangle, as claimed in claim 1 wherein said adjusting device produces, relative to a driving torque of said mangle roller, a counter-torque which acts on said mangle roller.

4. Laundry mangle, as claimed in claim 3, including two working cylinders, one of which absorbs driving torque on a gear side.

5. Laundry mangle, as claimed in claim 1, wherein said adjusting device is selected from the group of devices consisting of a working cylinder, a spring and a torque generating device.

6. Laundry mangle, as claimed in claim 1, wherein the force to be generated by said adjusting device is controlled by a setter.

7. Laundry mangle, as claimed in claim 1, further including stops to limit mobility of said mangle roller relative to the trough when said roller is in a position elevated relative to the trough.

8. A laundry mangle for counteracting a frictional force generated during service of the laundry mangle, said mangle comprising: a rotatable mangle roller having a longitudinal axis, a heatable trough for receiving laundry articles, an adjusting device for moving said mangle roller and said trough relative to each other so that an exertable force generated by said adjusting device counteracts a frictional force produced during service of the laundry mangle in such a manner that ironing pressure is constant or increases in a direction of an outlet side, wherein said adjusting device includes an inclined component which generates said exertable force having components in a vertical direction and in a horizontal direction, wherein said adjusting device engages said supporting arm, and said supporting arm is swivelable about a point for a movement selected from the group of movements consisting of translation and rotational movement in the service position, wherein said point is a movable bearing point.

9. Laundry mangle, as claimed in claim 8, wherein said adjusting device adjusts said mangle roller by a movement selected from the group of movements consisting of translational and rotational movement in a service position.

* * * * *